US007322585B2

(12) United States Patent
Handelman et al.

(10) Patent No.: US 7,322,585 B2
(45) Date of Patent: Jan. 29, 2008

(54) BOWLING BALL CARRIER

(75) Inventors: Bradley Handelman, Glencoe, IL (US); Michael Stout, Glen Ellyn, IL (US)

(73) Assignee: Strikeforce Bowling, LLC, Cicero, IL (US)

( * ) Notice: Subject to any disclaimer, the term of this patent is extended or adjusted under 35 U.S.C. 154(b) by 39 days.

(21) Appl. No.: 10/979,048

(22) Filed: Nov. 2, 2004

(65) Prior Publication Data

US 2006/0091627 A1 May 4, 2006

(51) Int. Cl.
*B62B 1/00* (2006.01)
*B62B 7/02* (2006.01)
*B62B 3/00* (2006.01)

(52) U.S. Cl. ..... 280/47.26; 280/47.19; 280/47.33; 280/79.2; 280/654; 280/47.34; 280/47.24

(58) Field of Classification Search ..... 280/47.26, 280/47.19, 47.33, 47.34, 47.24, 79.2, 654
See application file for complete search history.

(56) References Cited

U.S. PATENT DOCUMENTS

| | | | | |
|---|---|---|---|---|
| 119,930 | A | | 10/1871 | Adams |
| D169,336 | S | * | 4/1953 | Reece ..... D34/21 |
| 4,066,156 | A | | 1/1978 | Basile |
| 4,095,636 | A | | 6/1978 | Urion et al. |
| D249,492 | S | | 9/1978 | Morley |
| D249,662 | S | | 9/1978 | Morley |
| 4,166,530 | A | | 9/1979 | Robinson |
| 4,220,343 | A | | 9/1980 | Robinson |
| 4,305,584 | A | | 12/1981 | Leehan |
| 4,311,223 | A | | 1/1982 | Stein |
| D270,302 | S | | 8/1983 | Starzec |
| D281,112 | S | | 10/1985 | Nichols |
| 4,553,667 | A | | 11/1985 | Hudson et al. |
| D282,787 | S | | 2/1986 | Nichols |
| 5,074,571 | A | | 12/1991 | Reese |
| 5,135,275 | A | | 8/1992 | Kettelson |
| 5,145,229 | A | | 9/1992 | Metzger |
| 5,238,162 | A | | 8/1993 | LaCivita |
| D339,679 | S | | 9/1993 | Poulin |
| D349,401 | S | | 8/1994 | Carrillo |
| 5,791,469 | A | | 8/1998 | Be |
| 5,931,483 | A | | 8/1999 | Haynes |

(Continued)

OTHER PUBLICATIONS

New See/Saws (Bowling Ball Carriers), viewed at e-bay. Dowloaded Nov. 21, 2005 at http://www.cgi.ebay.com/ws/eBayISAPI.dll?ViewItem&item=7187309999&category=2905.

(Continued)

*Primary Examiner*—Christopher P. Ellis
*Assistant Examiner*—John R. Olszewski
(74) *Attorney, Agent, or Firm*—Michael P. Mazzo, LLC

(57) ABSTRACT

A bowling ball carrier such as a wheeled cart which, in one preferred embodiment, includes one or more removably attached ball bags which may have end supports for stability. In another embodiment of the invention, the bowling ball carrier may include removably attached panels to facilitate the placement of embroidery on the panels. In another aspect of the invention, a pouch with a resilient, elastic portion may be used to transport a bowling ball, and may be attached to the cart frame, allowing easy access to and removal of the ball from the pouch without having to remove the pouch from the cart frame.

14 Claims, 7 Drawing Sheets

U.S. PATENT DOCUMENTS

| | | | | |
|---|---|---|---|---|
| 5,950,636 | A * | 9/1999 | Hickey | 132/200 |
| 5,988,657 | A * | 11/1999 | Henkel | 280/47.25 |
| 6,082,757 | A * | 7/2000 | Lin | 280/654 |
| 6,099,023 | A * | 8/2000 | Be | 280/655 |
| 6,109,627 | A | 8/2000 | Be | |
| 6,164,425 | A * | 12/2000 | Latshaw | 190/18 A |
| 6,497,423 | B1 * | 12/2002 | Perelli et al. | 280/47.34 |
| D484,343 | S | 12/2003 | Plesnicar | |
| 2003/0135954 | A1 * | 7/2003 | Beckwith | 16/422 |
| 2003/0201655 | A1 | 10/2003 | Zellmer | |
| 2004/0182663 | A1 * | 9/2004 | Hsien et al. | 190/108 |
| 2005/0230277 | A1 | 10/2005 | Witherspoon | |

OTHER PUBLICATIONS

#seesaw Bowling Ball Denim Ball Carrier, viewed at PocketWater. Downloaded Nov. 21, 2005 at http://pocketwatcher.zoovy.com/product/SEESAW?META=froogle-SEESAW.

"Columbia 300" Bag Catalog 2004-2005 (20 pages).

"Bowl To Win" Ebonite 2004-2005 Bag Catalog (16 pages).

* cited by examiner 45
30a
31
20
26a
30
27a
27
40a
26
25
44
40
35a
35
50
60
65

BOWLING BALL CARRIER

BACKGROUND OF THE INVENTION

The present invention relates to bowling ball carriers.

Typically, bowlers use several bowling balls which may have different colors, weights and/or finger holes in an effort to train systematically or to enhance their score. As one non-limiting example, one bowling ball may provide optimum results for a given bowler when a bowling lane has been freshly oiled, while another may provide better results on that same lane after the lane has received a degree of use, resulting in the oil traveling down the lane. It is desirable, therefore, for some bowlers to carry several bowling balls at the same time.

Bowling ball carrier ("bowling bag") manufacturers have developed bags holding anywhere from one to six balls or more, depending upon the bag design. Given their weight, when one or more balls are carried, these bags may take the form of wheeled carts. Carts which, during wheeling, have two adjacent bowling balls along their width are referred to here as "two-ball width" carts, while carts during wheeling which have only a one-ball width are referred to as "in-line carts." Two-ball width carts, while more stable than in-line carts during turning, occupy a significantly larger surface area or "footprint" during travel. Footprint size can become significant during, for example, tournament play at a crowded bowling alley when floor space or the "concourse" is at a premium.

Bowling bags using a multi-tiered structure and carrying five or six balls, for example, are relatively heavy, weighing about 100 or 120 pounds, respectively. It is desirable, therefore, to provide a stable, durable bowling bag which, for example, will not deform, damage, drag on the floor and/or impede turning during wheeled, loaded travel.

Bowlers often adjust the number of bowling balls they may bring to different bowling venues depending upon various preferences and factors. When this occurs, minimizing the size of the bowling bag, as well as its footprint, would also be desirable.

Bowling bags often include labels, emblems or other embroidery bearing the name of the manufacturer, or the bowler's name, for example. Typically, after the bag has been manufactured, the label or emblem is laid on a machine which stitches or otherwise forms or attaches it to the bag. Embroidering a bag panel in this manner can be difficult because the bag portions not involved may interfere with or entangle the embroidery machine.

Accordingly, it would be advantageous to provide an in-line bowling bag whose carrying capacity may be adjusted depending upon the number of bowling balls to be carried. It would also be advantageous to provide a pouch supported by a bowling bag for readily retaining and allowing the removable of a bowling ball. Further, it would be advantageous to provide a bowling bag panel which maybe removably attached to the bag, enabling the removable panel to be embroidered more easily.

Definition of Claim Terms

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

"In-line" refers to a bowling bag which accommodates bowling balls which are not placed side-to-side, such that the bowling bag width is about the width of one bowling ball.

"Bowling bag" refers to a bowling ball carrier, including but not limited to a wheeled cart.

"Embroidery" refers to not only its conventional meaning of stitching or needlework, but also to labels or emblems which may be attached (whether by adhesives or otherwise) to a bowling bag.

"Panel" refers to a side or end of a bowling bag, or a portion thereof.

SUMMARY OF THE INVENTION

The objects mentioned above, as well as other objects, are solved by the present invention, which overcomes disadvantages of prior bowling ball carriers, while providing new advantages not believed associated with such carriers.

In a preferred embodiment of the invention, a bowling ball carrier is provided consisting of a wheeled cart including a frame and at least a first compartment adapted to store at least one bowling ball within the first compartment. The wheeled cart is capable of being pushed or pulled while in an upright positions The carrier, which may but need not be an in-line cart, also includes a second bag or second compartment attached to the first compartment and adapted to allow the user to store at least another bowling ball within the second bag. The second bag or compartment includes one or more support stands or end supports for supporting the second bag or compartment in a location distanced from the floor when one or more bowling balls are located there and the wheeled carrier is in an upright position. In a particularly preferred embodiment, the second bag or compartment may be removably attached to the first compartment of the wheeled cart, and may be located at a lower portion of the first compartment when the cart is in an upright position; this attachment may be effectuated using releasably attachable means such as VELCRO® straps or zippers, for example.

In another embodiment of the carrier, a third bag or compartment adapted to store another bowling ball(s) may be provided, and may be removably attached to the frame above the first compartment when the carrier is in an upright position. A handle for the wheeled cart may be provided at an upper end of the cart when the cart is in an upright position. The third bag or compartment may consist of a durable, flexible pouch, such as made of nylon or a nylon blend, having an elastic strap or cord, or other elastic and/or resilient means, for receiving and retaining a bowling ball. The flexible pouch may be fit over the frame and/or handle of the cart for removable attachment to the cart, allowing easy removal of a bowling ball from the pouch without requiring removable of the pouch from the frame.

In yet another embodiment, a bowling ball carrier, which may but need not consist of a wheeled cart, may include at least one removably attached panel for receiving embroidery. Removable attachment may be effectuated using zippers, other releasably attachable means such as VELCRO® straps or other means.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings. The drawings illustrate currently preferred embodiments of the present invention. As further explained below, it will be understood that other embodiments, not shown in the drawings, also fall within the spirit and scope of the invention.

DETAILED DESCRIPTION OF THE PREFERRED EMBODIMENTS

Set forth below is a description of what are currently believed to be the preferred embodiments and/or best examples of the invention claimed. Future and present alternatives and modifications to these preferred embodiments are contemplated. Any alternatives or modifications which make insubstantial changes in function, in purpose, in structure or in result are intended to be covered by the claims of this patent.

Figure 1:
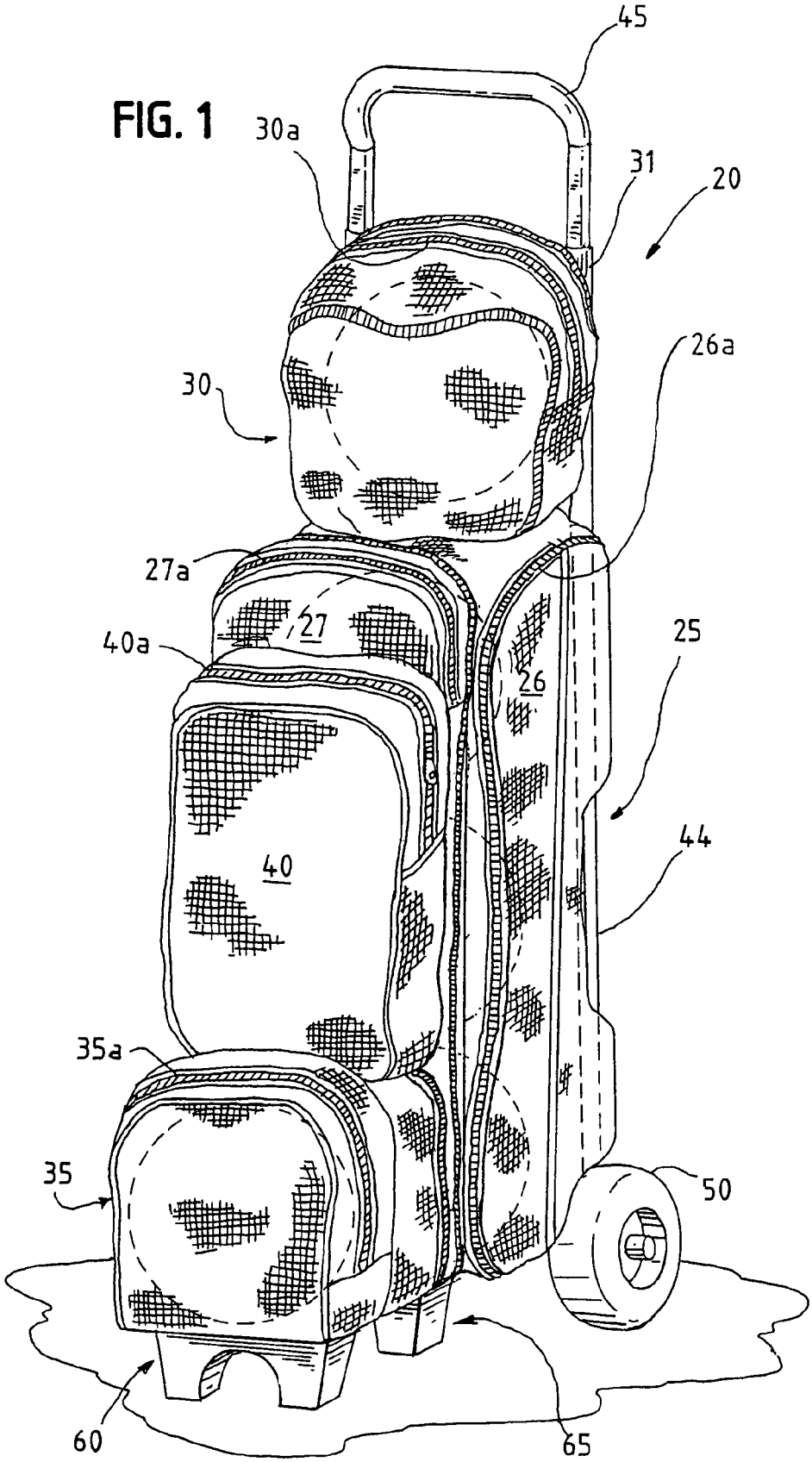
FIG. 1 is a front and side perspective view of a preferred embodiment of a 5-ball bowling carrier/bag of the present invention.

Referring first to FIG. 1, a preferred embodiment of the bowling ball carrier or bowling bag of the present invention is shown, designated generally with the reference numeral 20. In this embodiment, bowling bag 20 includes a main body 25, an upper spare bag 30, a lower spare bag 35, an outer compartment 40, interior compartment 27, a handle 45, wheels 50 and outer and inner support stands 60, 65, respectively.

Figure 2:
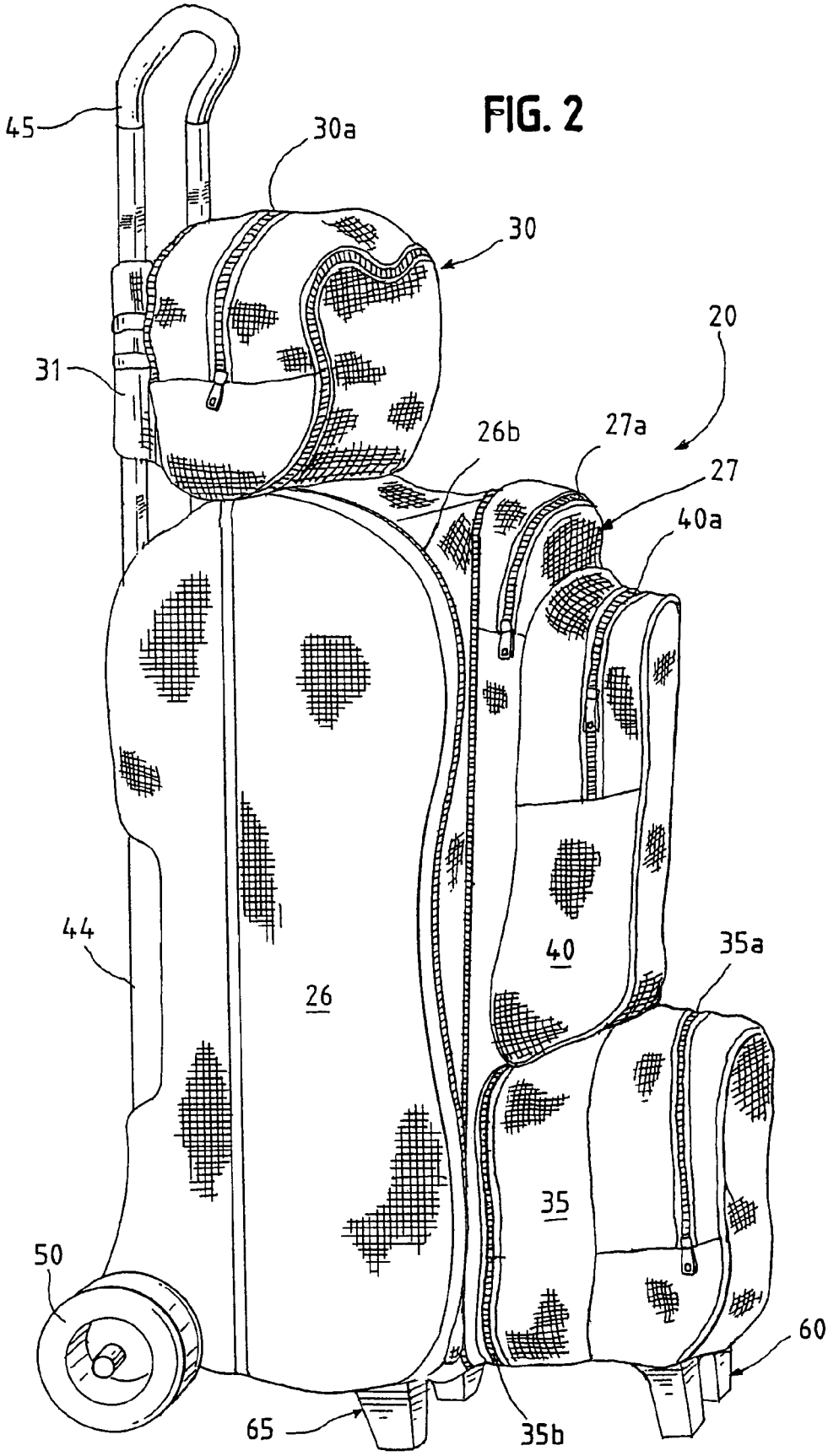
FIG. 2 is a side perspective view of the bowling bag shown in FIG. 1.
Figure 3:
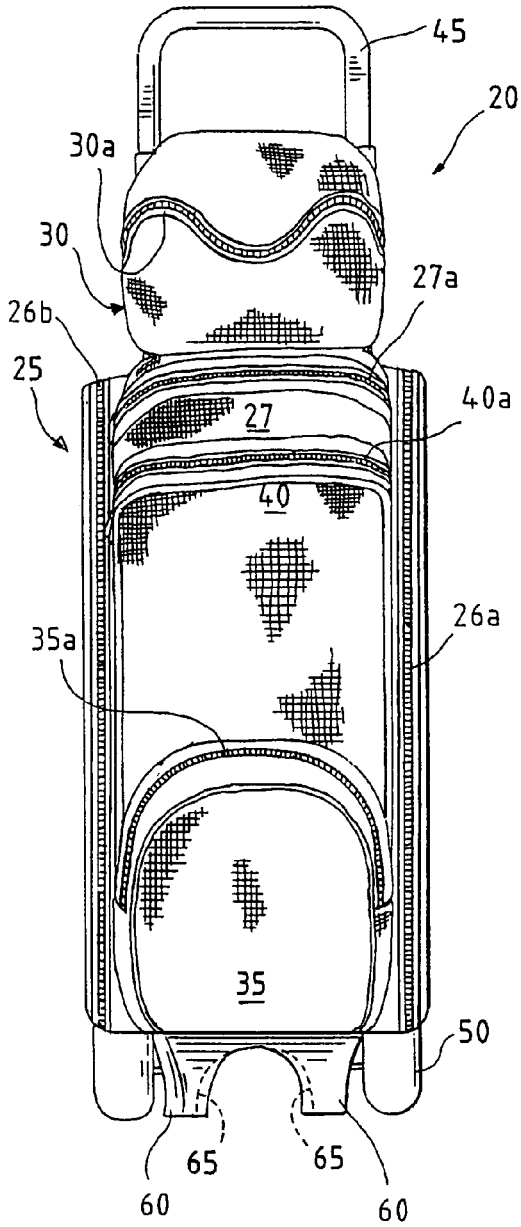
FIG. 3 is a front perspective view of the bowling bag shown in FIG. 1.
Figure 4:
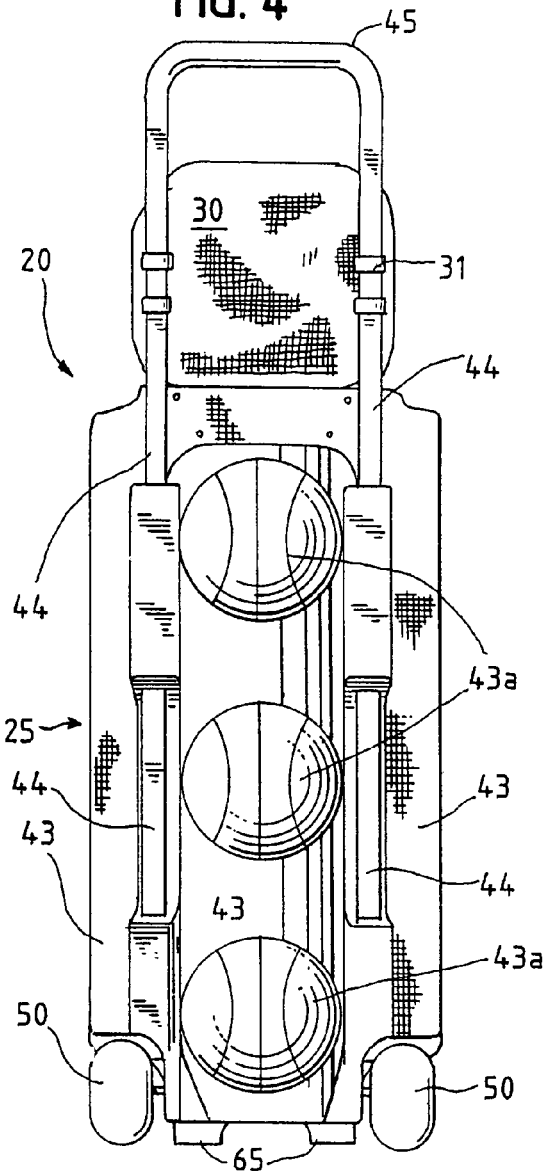
FIG. 4 is rear perspective and partially cut-away view of the bowling bag shown in FIG. 1.
Figure 5:
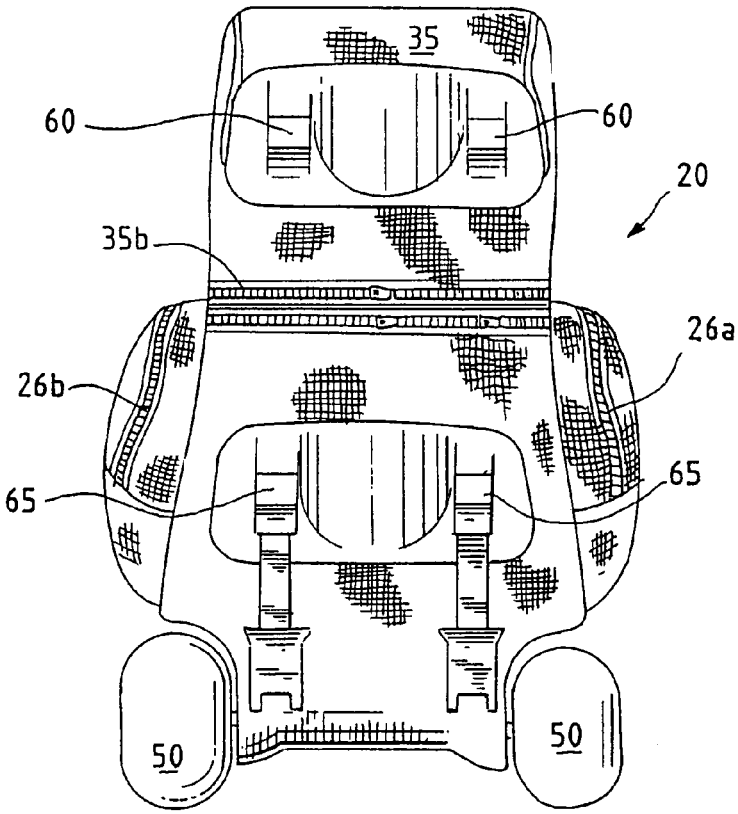
FIG. 5 is a bottom view of the bowling bag shown in FIG. 1.
Figure 6:
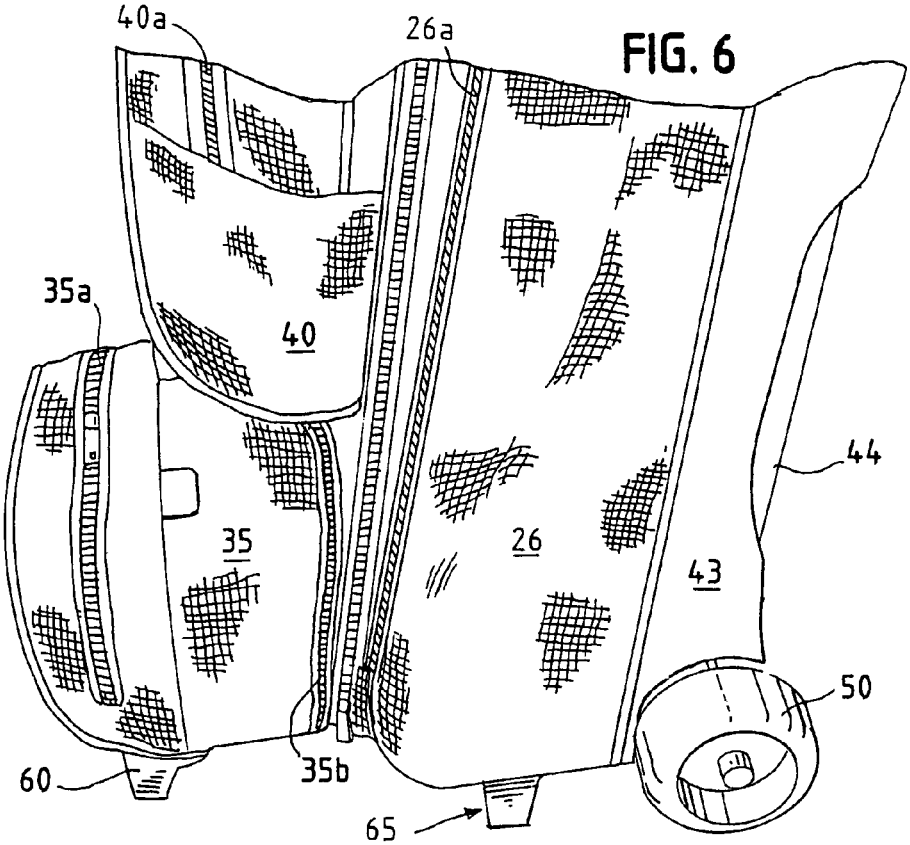
FIG. 6 is a partial side perspective view of a lower portion of the bowling bag shown in FIG. 1.
Figure 7:
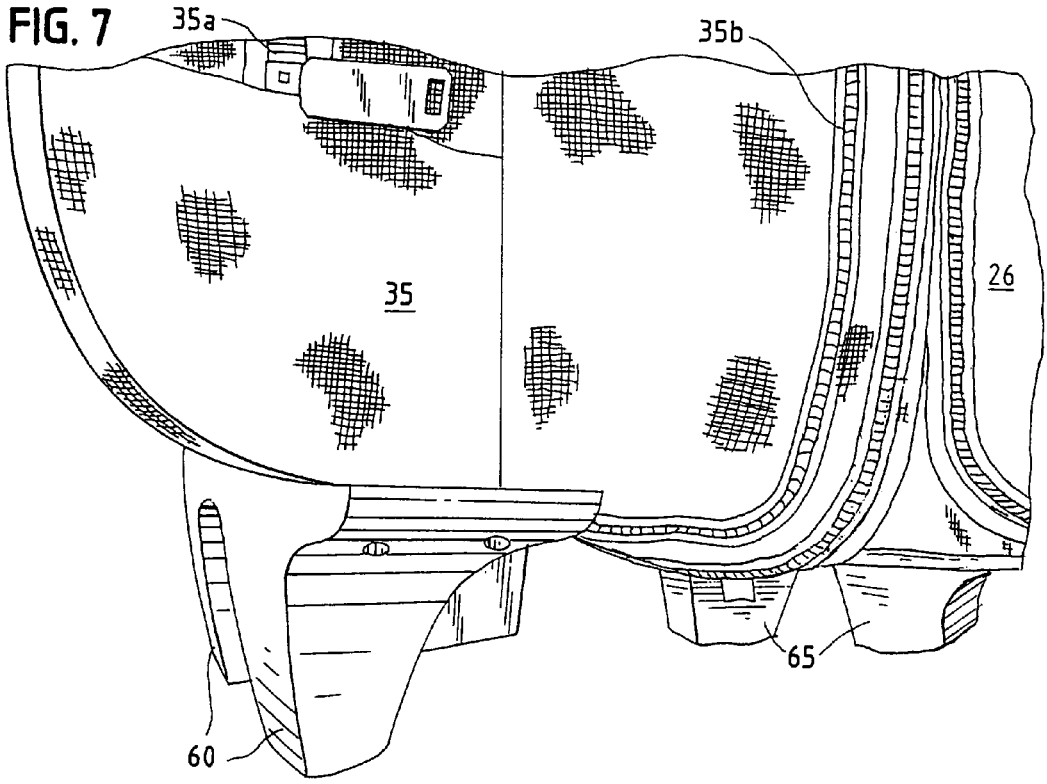
FIG. 7 is an enlarged portion of the lower bowling bag portion shown in FIG. 6.
Figure 8:
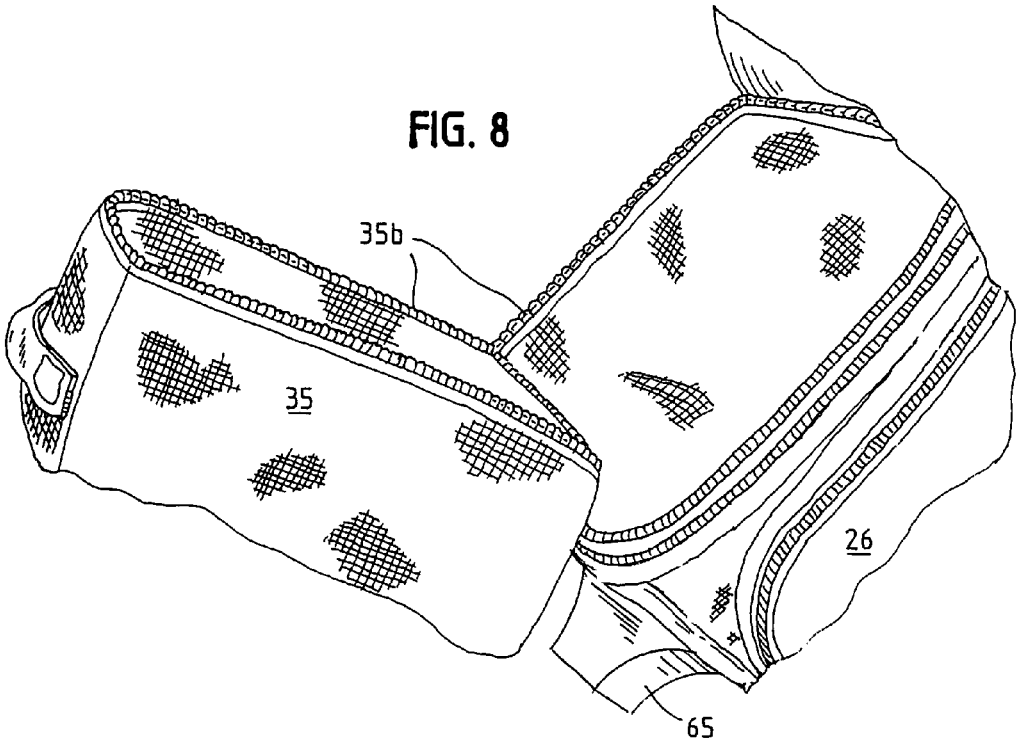
FIG. 8 is a side and top perspective view of the outer, lower, removably attached "spare" bag shown in FIG. 1.
Figure 9:
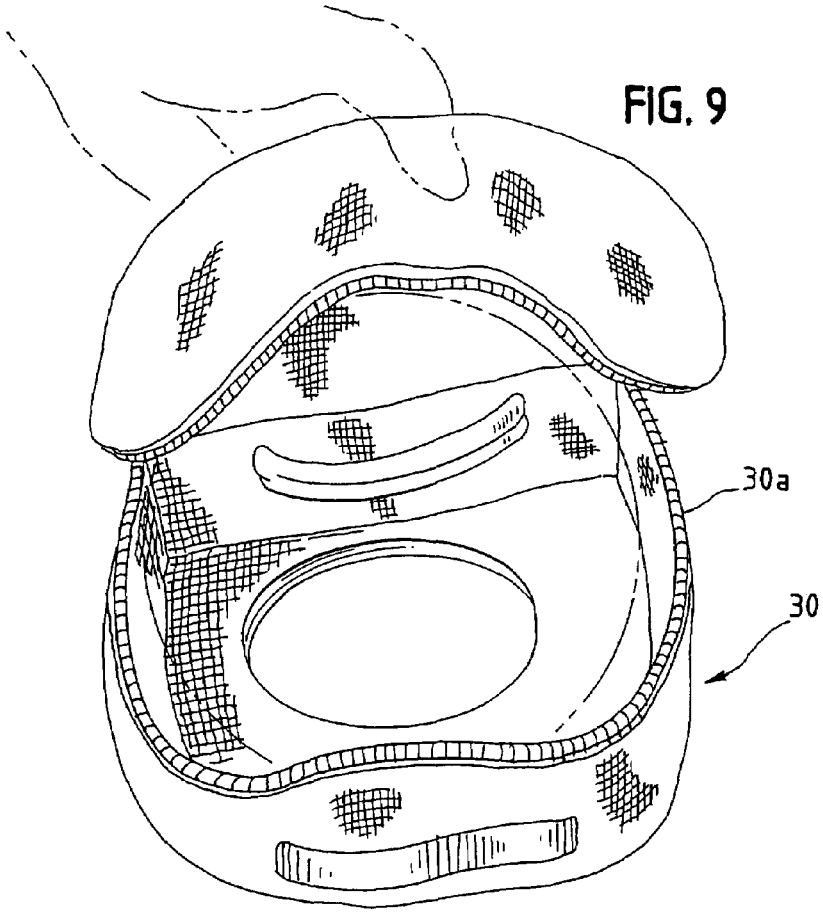
FIGS. 9 and 10 are perspective views of the uppermost removably attached "spare" bag shown in FIG. 1.
Figure 10:
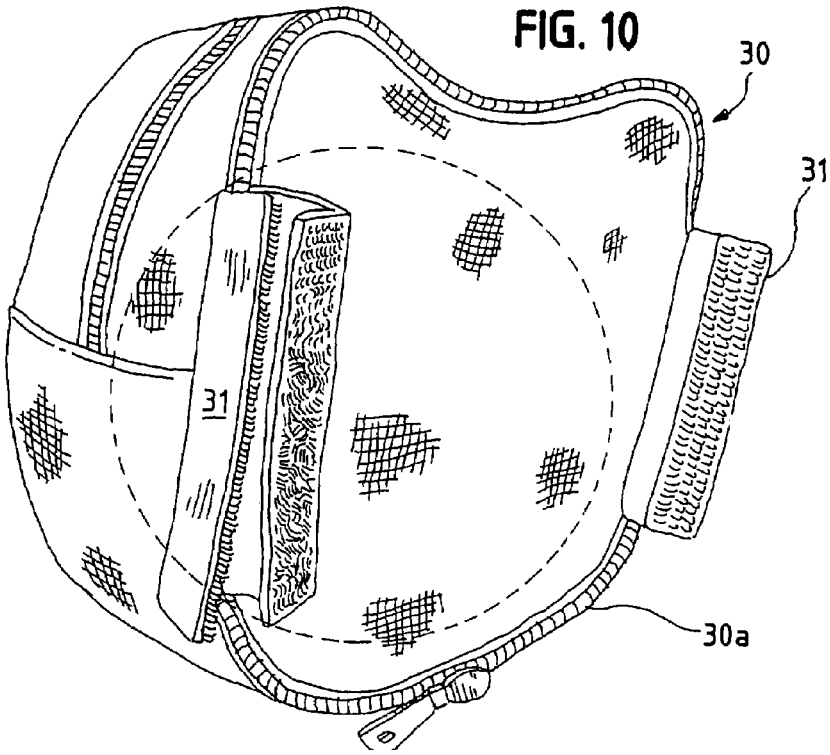

Referring now to FIGS. 2-4, main body 25 may include a canvas top 26, a hard molded plastic bottom 43, and a pair of metal support bars running length-wise along bowling carrier 20, and terminating in an upper handle 45. Main body 25 may be opened and closed in various ways, such as by using a zippered connection 25*a*. Bars 44 may pass through apertures in the hard molded plastic bottom 43. In the preferred embodiment, three reinforced ridged circular portions 43*a* of molded plastic may be used, each designed to reliably support and transport a standard 6-16 pound bowling ball. Mesh partitions (not shown) may be provided within main body 25 to maintain separation of the bowling balls during transport. Preferably, carrier 20 includes wheels 50 and a support stand such as a pair of legs 65 serving as a cart support stand and located at a distal portion of main body 25.

Main body 25 may also include a stitched, canvas compartment 40 with a zippered opening 40*a*, for example, to accommodate bowling gloves, scorecards, toiletries or other sundry items. In a preferred embodiment, a removably attached canvas compartment 35 may accommodate an additional bowling ball/spare. Spare compartment 35 may be opened and closed using, e.g., zippered connection 35*a*, and may be removably attached to a lower portion of main body 25 using, e.g., zippered connection 35*b* that allows compartment 35 to be completely removed from main body 25 when compartment 35 is not needed, for example. Alternate attachment mechanisms may be employed such as releasably attachable VELCRO® straps, buttons, stitching or other means. Preferably, spare compartment 35 includes its own support stand, such as legs 60, to keep compartment 35 from dragging on the ground when it carries a bowling ball and for enhanced cart stability during cart transport.

Bowling carrier 20 may also include an upper, canvas spare compartment 30, which may be removably attached to an upper portion of main body 25. Compartment 30 (which may be replaced with the "joey" referenced below) may be opened and closed using zippered connection 30*a* for example. As one non-limiting example, compartment 30 may be attached to carrier 20 using bands 31 to upper portions of support bars 43, as shown in FIGS. 1-4. Again, alternate attachment mechanisms may be employed such as Velcro®, buttons, stitching or other means. This allows the preferred embodiment of carrier 20 shown in the drawings to carry five bowling balls, for example, during in-line transport.

Referring to FIGS. 1-2, canvas side compartments 26 may also be provided, with zippered openings 26*a*, 26*b* for further storage, while interior compartment 27 with zippered opening 27*a* may also be provided.

While, in the preferred embodiment, a sturdy and durable canvas material maybe employed, the various bags/compartments employed with carrier 20 may be made, instead, of a durable plastic or other material.

It is believed that the placement of removable compartment 35 at the lower, outer end of wheeled cart 20 improves the overall cart stability during upright, wheeled travel of the cart. The use of support legs 60 beneath compartment 35, in addition to the use of support legs 65 beneath main cart body 25, provides added stability when the cart is placed in a stationary, upright position.

In-line wheeled carts for carrying bowling balls may not be as stable as wider carts during transport and, particularly, during sharp turning of the cart. For this reason, it may be desirable, in order to provide a more stable cart, to use a wider wheel base and/or larger wheels.

Figure 11:
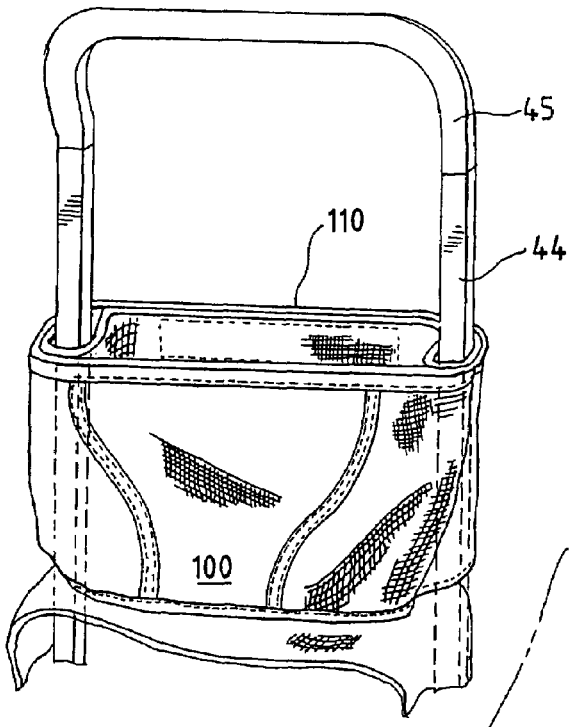
FIGS. 11-13 are partial, perspective views of an upper portion of the carrier, illustrating another aspect of the invention.
Figure 12:
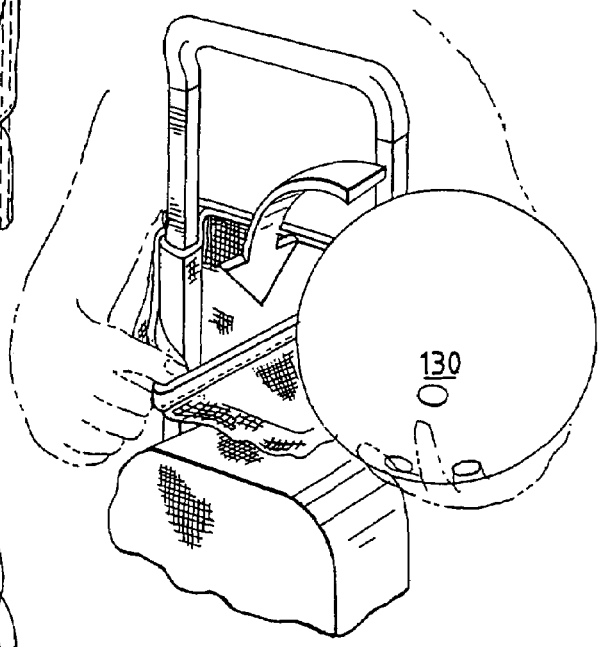
Figure 13:
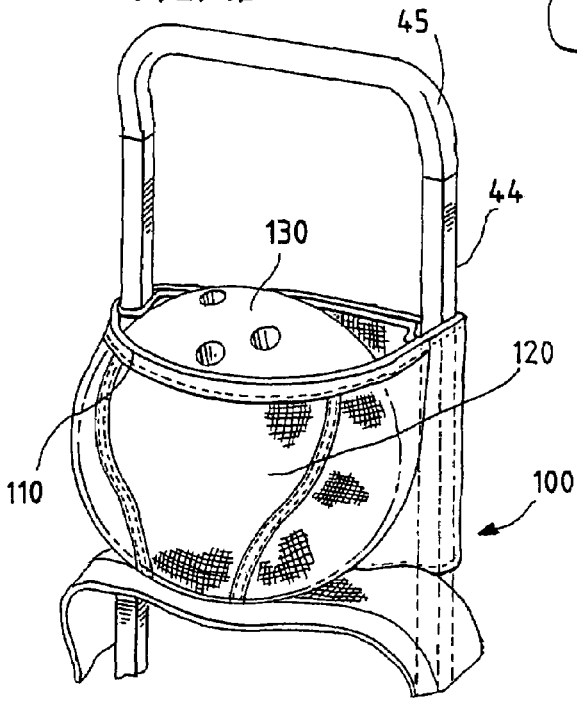

Referring now to FIGS. 11-13, a preferred embodiment is shown of another aspect of the invention, a pouch or "joey" for holding a bowling ball, which may be utilized instead of, or in addition to, compartment 30 for example. Pouch 100 may include an elastic cord 110, which may be located on an upper portion of the pouch to retain bowling ball 130, while allowing the ball to be easily removed from the pouch when needed. Joey 100 may be fit over the upper frame, for example, of any of a variety of sizes of bowling ball carriers. Pouch 100 is preferably made of a durable material such as nylon or a nylon blend. In one preferred embodiment, the pouch includes a stretchable mesh 120 of nylon Dalington (e.g., 14.6% nylon, 85.4% span/elastic), while the opposing side may be a webbing made of nylon, double hbt. The pouch may be coated with a polyester (e.g., polyester 600 Denier polyurethane coating, 64T density (quantity or yam/thread in a 1" by 1" square will be 64)) or nylon (e.g., nylon Oxford 210 Denier polyurethane coating, 110T density) coating. The sides of pouch 100 may be wrapped around the frame of the cart, such as support bars 44. Velcro may be provided along the length of the top of webbing, for example, so that the sides of the pouch may be secured around the bars, as shown in FIG. 11. For added support, pouch 100 may be secured to support bars 44 using an attachment mechanism such as releasably attachable VELCRO® strips, but this is not necessary. Pouch 100 allows easy access to the bowling ball within the pouch, and easy removal of the bowling ball from the pouch without first having to remove the pouch from the frame or support bars.

Joey or pouch 100 may be used with a wheeled cart including a main body consisting of a "2-ball" bag or a "3-ball" bag, for example. Pouch 100 may but need not be used with an in-line cart. Also, additional compartments such as 35, 40 shown in FIG. 1 may but need not be used with the joey. Conceivably, joey 100 may be used with bowling ball carriers other than wheeled carts, although it is preferred that the pouch be wrapped around a sturdy frame for stability.

In a particularly preferred embodiment, not shown in the drawings, removably attachable embroidery may be provided on bowling bag 20. This may include labels, emblems or similar materials, generally referred to as "embroidery" here, bearing the name of the manufacturer, or the bowler's name, for example. This may also include entire bag panels, for example. Such embroidery and/or bag panels may be removably attached such as by using zippers, releasably attachable VELCRO®, buttons, loops, or other attachment mechanisms. In this way, bag panels may be embroidered without interfering with or entangling the embroidery machine.

It will be understood that various modifications to the preferred embodiment disclosed above may be made. The above description is not intended to limit the meaning of the words used in the following claims that define the invention. Rather, it is contemplated that future modifications in structure, function or result will exist that are not substantial changes and that all such insubstantial changes are intended to be covered by the following claims.

We claim:

1. A bowling ball carrier, comprising:

a first wheeled bowling ball bag comprising a frame and at least one compartment with at least one internal support means for storing at least one bowling ball in a stationary position within the compartment, the first bowling ball bag being capable of being pushed or pulled while in an upright position; and a second bowling ball bag attached to the compartment and adapted to allow the user to store at least another bowling ball in a stationary position within the second bag, wherein the second bag includes one or more end supports for supporting the second bag in a location off the floor when one or more bowling balls are located in the second bag and the first wheeled bowling ball bag is in an upright position.

2. The bowling ball carrier of claim 1, wherein the second bowling ball bag is removably attached to the compartment of the first wheeled bowling ball bag.

3. The bowling ball carrier of claim 1, wherein the second bowling ball bag is removably attached to a lower portion of the compartment of the first wheeled bowling ball bag when the first bag is in an upright position.

4. The bowling ball carrier of claim 1, wherein the second bowling ball bag is removably attached to the compartment of the first bag using releasably attachable straps.

5. The bowling ball carrier of claim 1, wherein the second bowling ball bag is removably attached to the compartment of the first bag using one or more zippers.

6. The bowling ball carrier of claim 1, wherein the carrier comprises an in-line bag, which accommodates bowling balls which are not placed side-to-side, such that the bag width is about the width of one bowling ball.

7. The bowling ball carrier of claim 1, wherein a third bowling ball bag is removably attached to the frame, the third bowling ball bag being adapted to store at least another bowling ball.

8. The bowling ball carrier of claim 7, further comprising a handle located at an upper end when the first bowling ball bag is in an upright position.

9. The bowling ball carrier of claim 8, wherein the third bowling ball bag comprises a pouch adapted to snugly envelop a bowling ball and which may be fit over and removably attached to the handle.

10. A bowling ball carrier, comprising:

a wheeled bowling ball bag comprising a frame and at least a first compartment with at least one internal support for storing at least one bowling ball in a stationary position within the first compartment, the bag being capable of being pushed or pulled while in an upright position; and a second compartment with at least one internal support means for holding at least another bowling ball in a stationary position within the second compartment, the second compartment including one or more end supports for supporting the second compartment in a location distanced from the floor when one or more bowling balls are located in the second compartment and the wheeled bag is in an upright position.

11. The bowling ball carrier of claim 10, further comprising a third compartment located at an upper end of the wheeled cart when the wheeled cart is in the upright position, the third compartment for holding at least another bowling ball in a stationary position.

12. The bowling ball carrier of claim 11, wherein the third compartment comprises a pouch adapted to snugly envelop a bowling ball with resilient means for retaining and allowing easy removal of a bowling ball.

13. The bowling ball carrier of claim 12, wherein the resilient means enables the pouch to be removably attached to the frame or a handle of the wheeled cart.

14. An in-line bowling ball carrier, comprising:

a first wheeled bowling ball bag attached to a frame the bag having internal support means for holding two or more bowling balls in a stationary position, allowing the user to receive or remove the balls from the wheeled bag;

wherein the wheeled bowling ball bag is adapted to be pulled or pushed as a cart while in an upright position; and a second bowling ball bag removably attached to the first wheeled bowling ball bag, the second bowling ball bag having a support stand and internal support means for holding at least one bowling ball in a stationary position, allowing the user to receive or remove the bowling balls from the second bag;

wherein the first wheeled bag and the second bag comprise in-line bags, which accommodate bowling balls which are not placed side-to-side, such that the bag width is about the width of one bowling ball.

* * * * *